United States Patent [19]

Nielsen

[11] 4,395,831

[45] Aug. 2, 1983

[54] DRYER VENT

[76] Inventor: Edward G. Nielsen, 7295 Cascade Woods Dr., Grand Rapids, Mich. 49506

[21] Appl. No.: 778,887

[22] Filed: Mar. 18, 1977

[51] Int. Cl.[3] ..... F26B 11/04

[52] U.S. Cl. ..... 34/86; 34/133; 34/235

[58] Field of Search ..... 34/86, 235, 19, 82, 34/90, 91; 55/480, 493, 505, 506, 507, 511, DIG. 31, 418, 501; 251/228; 137/625.44, 875; 165/DIG. 2

[56] References Cited

U.S. PATENT DOCUMENTS

| | | | |
|---|---|---|---|
| 1,821,842 | 9/1931 | Long | 55/319 |
| 2,575,499 | 11/1951 | Manow | 55/493 X |
| 3,716,925 | 2/1973 | Hartung | 34/235 X |
| 4,011,662 | 5/1977 | Davis et al. | 34/86 X |
| 4,034,482 | 7/1977 | Briscoe | 34/86 X |
| 4,122,612 | 10/1978 | Mrofchak | 34/235 X |

*Primary Examiner*—Larry I. Schwartz

*Attorney, Agent, or Firm*—Varnum, Riddering, Wierengo & Christenson

[57] ABSTRACT

A vent apparatus for controlling the flow of heated exhaust air from a clothes dryer has a housing connected to the heated exhaust conduit and a filter within the housing for filtering the exhaust gases. Controls regulate the relative amounts of exhaust gases directed outside the dryer room and through the housing into the dryer room. In one embodiment, the heated dryer air is ducted through the housing and the control is a valve which directs the gas either into the housing or through the exhaust outlet of the housing. The invention channels moist, heated air into a house in desired proportions to conserve heat energy and to humidify the home in the winter.

5 Claims, 7 Drawing Figures

DRYER VENT

BACKGROUND OF THE INVENTION

1. Field of the Invention

This invention relates to controlling flow of exhaust gases from clothes dryers either outside of the home or into the home. In one of its aspects, the invention relates to a vent apparatus for controlling the flow of clothes dryer air into the dryer room. In another of its aspects, the invention relates to an apparatus for utilizing the heat and humidity from a clothes dryer in a home heating system.

2. State of the Prior Art

Clothes dryers used by many homes conventionally exhaust the heated dryer air outside the home. The air exhausted from the dryer is air which initially is taken from the dryer room at about 70° F. and is heated further by the dryer. Make-up air for the dryer room is drawn into the room from outside the building. The make-up air in the winter is much colder and drier than the 70° heated air which it replaces. Thus, the air must be heated and humidified to maintain the home at a given temperature. Under these circumstances, considerable energy in the form of heat and humidity must be added to the house when the clothes dryer is in operation.

The circulation of heated dryer air into the laundry room has been known for some time. This concept is disclosed in the U.S. Pat. No. 3,892,048 to Jacobson, (issued July 1, 1975), and U.S. Pat. No. 2,983,050 to Alaback (issued May 9, 1961). In Jacobson, a small dryer exhausts heated air to the front of the dryer through a screen. An exhaust pipe, blocked during delivery of the heated air to the front grill of the dryer is provided for venting the dryer air to the outside during warmer weather.

In Alaback, a portion of the exhaust air from the dryer can be diverted to a top portion of the dryer for room heating or clothes drying on a rack on top of the dryer. Although some adjustment is possible in Alaback, no complete recycle of the dryer air into the laundry room is possible without completely blocking the exhaust. Accordingly, some portion of the heated dryer air will always be ducted outside the room.

The use of exhaust air from a dryer for room heating is also disclosed in the U.S. Pat. No. 3,999,304 to Doty, (issued Dec. 28, 1976). In Doty, a portable filter box with multiple filters is connected directly to the dryer outlet.

The recycling of dryer air to a heat exchanger within a burner housing has been disclosed in the U.S. Pat. No. 3,969,070 to Thompson, (issued July 13, 1976). The use of heated dryer air for drying clothes in an external clothes bag is disclosed in the U.S. Pat. No. 3,197,886 to Brame et al, (issued Aug. 3, 1965).

The dryers having the recirculation outlets built into the dryer housings have experienced some problem with lint in the households, due to incomplete filtration, and condensation of moisture in and around the dryers. Thus, the dryers with the self-contained recirculating heat have not been especially successful to my knowledge.

The energy shortages and the higher prices of energy have rekindled interest in utilizing waste heat from dryers and avoiding the unnecessary energy consumption due to drawing cold air inside during the wintertime.

SUMMARY OF THE INVENTION

According to the invention, a vent assembly is provided for use in combination with a clothes dryer wherein the dryer has an outlet pipe extending therefrom for venting heated air outside the room. The vent assembly comprises a housing having an open front and a generally open interior, a conduit extending through the housing from an inlet opening in the housing to an outlet opening in the housing, means on the housing for coupling the dryer outlet pipe to the conduit at the outlet opening thereof and means on the housing coupling an exhaust pipe to the conduit at the outlet opening thereof for exhausting heated air from the room to the outside. A valve means is provided in the conduit for adjustably controlling the relative portions of heated air passing from the inlet opening to either of the interior of the housing or to the outlet. The valve means is adapted to substantially completely cut off the flow of heated air to the housing interior or alternatively to substantially completely cut off the flow of heated air to the outlet. A filter means is provided at the open front of the housing to completely cover the same. Means are provided for releasably retaining the filter means in the open front of the housing. Thus, with the invention, heated air from the dryer can be vented in whole or in part to the outside or to the inside of the room through the vent assembly.

The releasable retaining means desirably comprises a frame pivotably mounted at one side to one side of the housing and means for releasably securing the other side of the frame to the opposite side of the housing.

The valve means in a preferred embodiment comprises an opening in the conduit and a valve element movable from a first position covering the opening to a second position blocking flow through the conduit downstream of the conduit opening. The valve element is of a size and shape sufficient to cover the conduit opening when it is in the first position and to block the flow through the conduit when it is in the second position. Preferably, an actuator rod is pivotably connected at one end to the valve element and extends through the housing at another end so that the valve element is manually operable from outside the housing. The valve element desirably is pivotably mounted to the conduit at a point downstream of the conduit opening. In order to provide for adjustments of various proportions of the heated air to the room and to the outside, the actuator rod is frictionally held in the casing so that the valve element will stay in any given adjusted position.

Further, according to the invention, a room having a clothes dryer with a hot outlet connected to an exterior location through an exhaust conduit has a vent means coupled to the exhaust conduit for venting dryer air into the room. The vent means includes a housing separate from the dryer and having a generally hollow interior, an inlet opening and a vent opening in communication with the inlet opening. Filter means are provided in the housing between the inlet and vent openings for removal of lint. Means in at least one of the exhaust conduits and the vent means control the flow of dryer air adjustably between the exterior location and the vent means so that the relative proportion of dryer air to the vent means and the exterior location can be varied from substantially none to substantially all of the dryer air.

In one enbodiment, the exhaust conduit extends through the housing and the control means are provided in the housing. In another embodiment, the exhaust conduit is vented directly to the outside and the vent means is connected to the exhaust conduit through a branch conduit. In this embodiment, the control means is provided in the exhaust conduit and in the branch conduit. Further, the vent opening can be an open face in the housing. Alternatively, the vent opening can be a smaller conduit opening connected directly to a furnace air circulation system in order to circulate the heated air throughout the entire house. In this latter case, controls are preferably provided between the dryer and the drive motor for the circulating fan in order to circulate air through the air ducts when the dryer is operating. In this manner, condensation of moisture is prevented or minimized within the air circulating system.

BRIEF DESCRIPTION OF THE DRAWINGS

The invention will now be described with reference to the accompanying drawings in which.

DESCRIPTION OF THE PREFERRED EMBODIMENTS

Figure 1:
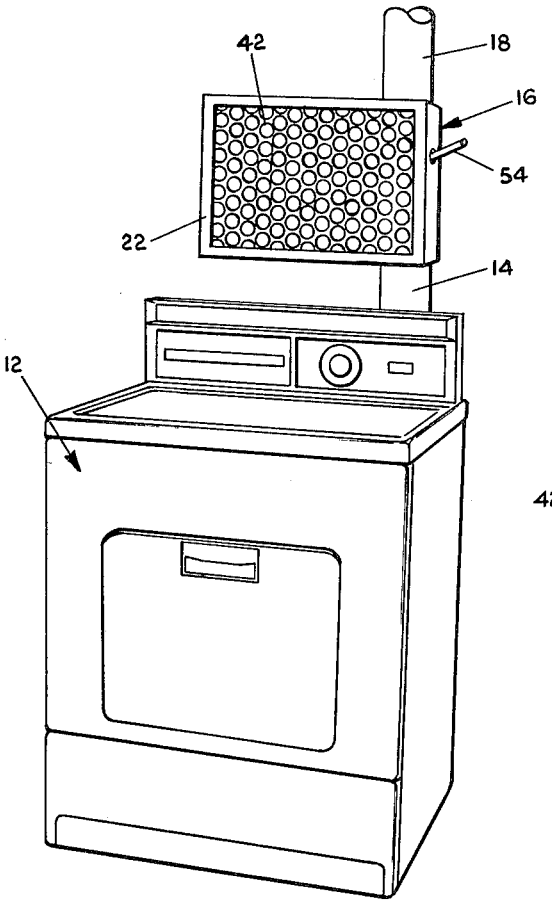
FIG. 1 is a perspective view of a dryer vent according to the invention in relationship to a conventional dryer and ducting therefor.

Referring now to the drawings and to FIG. 1 in particular, there is shown a dryer 12 of conventional design having a vent exhaust pipe 14 connected to an interior vent assembly 16. An exhaust pipe 18 leads from the interior vent assembly to an outside location through the wall by conventional means (not shown).

As seen in FIGS. 1 through 3 and 5, the vent assembly 16 comprises a housing 20 having a front door frame 22, pivotably mounted to the housing through a hinge 24 and suitable screw fasteners 26. A catch member 28 is provided on the housing opposite the hinge 24 through suitable screw fasteners 30 and a latch member 32, secured to the door frame 22 through screw fasteners 34, is provided in juxtaposition to the catch member 28 to securely fasten the door frame 22 in a closed position. The catch member 28 is a plastic member hinged at one end and having a hollow interior to receive the latch member 32. This latching mechanism is a conventional fastener which is commercially available.

An outlet fitting 36 of tapered construction is provided at the upper part of the housing 20 to receive the exhaust pipe 18 (FIG. 1). In similar manner, an inlet fitting 38 is provided at the bottom portion of the housing 20 to receive the vent exhaust pipe 14. The fittings 36 and 38 are conventional dryer pipe sections of for example 4" diameter, which are in common use in dryer exhaust systems.

A retaining flange 40 (FIG. 5) is provided around the interior of the housing just inside the front door frame 22. The retaining flange 40 is spaced from the front edge ofthe housing a distance approximately equal to the thickness of a standard fiberglass furnace filter. Thus, a furnace filter 42 is positioned in the housing at the front opening between the flange 40 and the front door frame 22. The furnace filter 42 is a standard furnace filter which conventionally has a rectangular rim which supports a central fiberglass batting.

Figure 2:
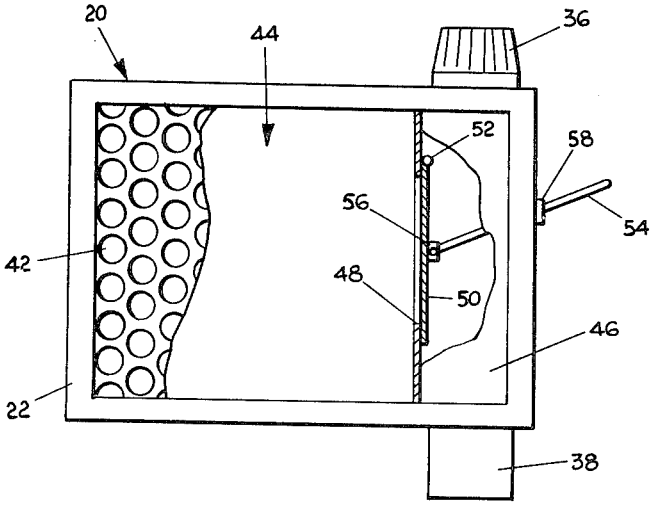
FIG. 2 is a front view, partially broken away, of the dryer vent illustrated in FIG. 1.

The housing 20 has a generally hollow interior 44 and a conduit 46 extending from and communicating with the inlet fitting 38 and the outlet fitting 36. As illustrated in FIG. 2, air flow from the dryer can pass through the conduit 46 from the inlet fitting 38 to the outlet fitting 36.

Figure 3:
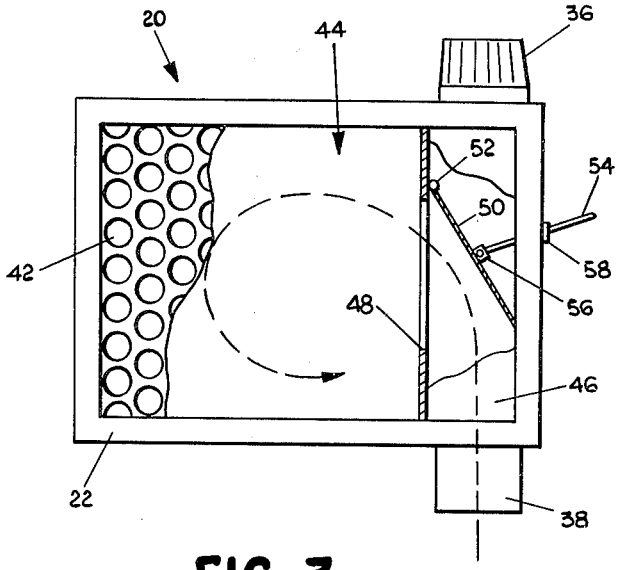
FIG. 3 is a front view, partially broken away and similar to FIG. 2, of the dryer vent shown in FIG. 1 and illustrating the control lever in a deflecting position.

An opening 48 is provided in the side of the conduit 46 adjacent to the hollow interior 44. A baffle deflector 50 is positioned within the conduit 46 and is hinged at 52 to the interior wall of the conduit 46 for rotational movement between a closed position blocking the opening 48 (illustrated in FIG. 2) and an open diverting position substantially blocking flow between the inlet fitting 38 and the outlet fitting 36 (FIG. 3). Thus, in the diverting position illustrated in FIG. 3, the flow of air through the conduit is diverted through the opening 48 and into the hollow interior 44 of the housing 20. The baffle deflector 50 thus, has a shape which covers the opening 48 when the baffle is in the closed position illustrated in FIG. 2 and is shaped to conform with the interior of the conduit 46 when the baffle is in the diverting position illustrated in FIG. 3. Preferably, the conduit 46 is square in cross-section and the baffle deflector 50 will therefore be rectangular in shape. Although a complete seal is typically not made by deflector 50, substantially all the heated air can be diverted into the open interior of the housing or directed through the conduit 46. A complete seal could, however, be made if desired.

Figure 4:
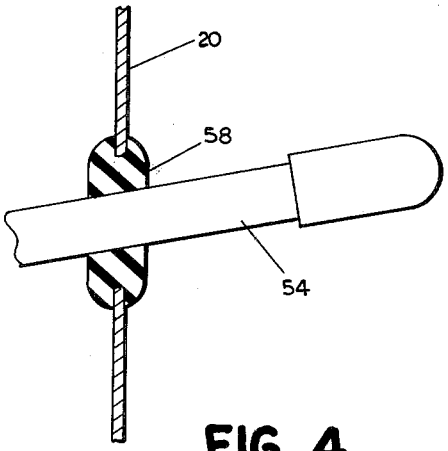
FIG. 4 is an enlarged detailed view of the connection between the control lever and the vent housing.
Figure 5:
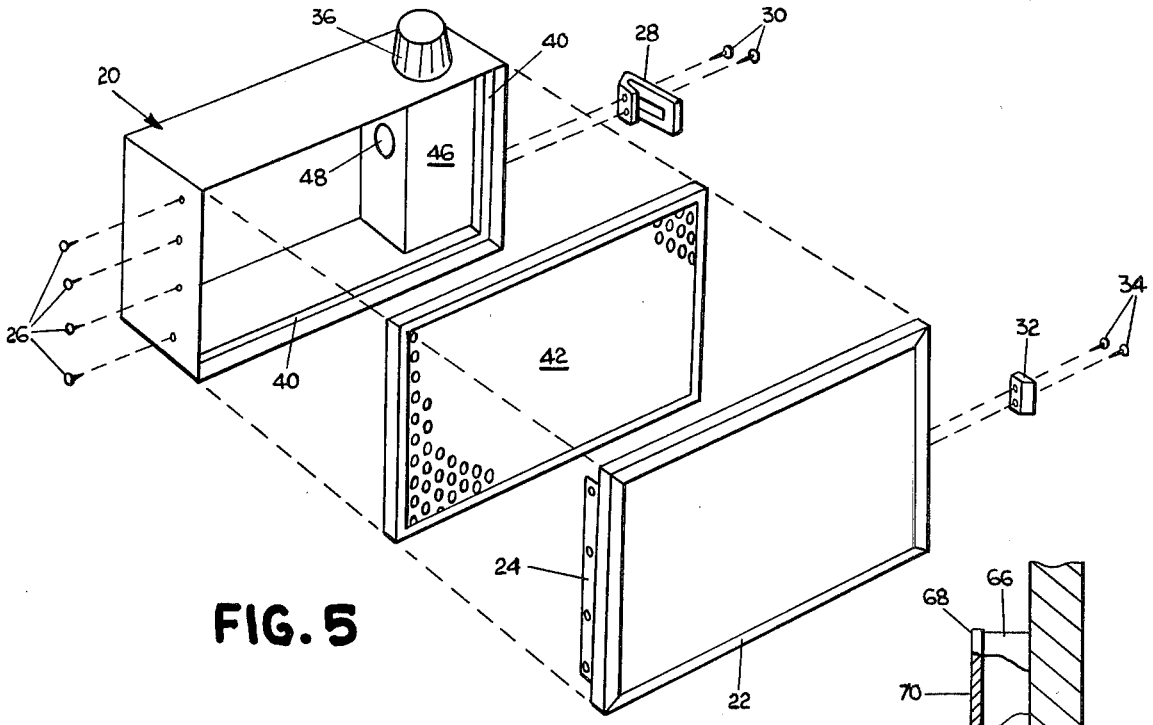
FIG. 5 is an exploded view of vent assembly according to the invention.

An actuator rod 54 is pivotably mounted at pivot mounting 56 to the baffle deflector 50 and extends through the side of the housing 20 for exterior manual operation of the baffle deflector. As seen in FIG. 4, the side of the housing 20 has a rubber grommet 58 with a central opening in which the actuator rod 54 is slidably received. The rubber grommet 58 permits a relatively noiseless operation of the actuator rod and also permits some limited articulation of the actuator rod within the opening of the grommet as the rod moves between the diverting position and the close position while maintaining a tight seal between the opening in the housing 20 and the rod 54.

In operation of the form of the invention illustrated in FIGS. 1 through 5, the vent assembly 16 is connected to vent exhaust pipe 14 of the dryer 12. When the dryer operates, heated air from the dryer, containing moisture, will be exhausted from the dryer through the vent exhaust pipe 14 and will pass into the conduit 46. During warmer weather, when it is desirable to vent the heated dryer air to the outside, the actuator rod 54 is pushed inwardly as illustrated in FIG. 2 so that the heated air passes directly through the conduit 46 to the outside of the room. In colder weather, where it is desirable to vent the dryer air to the inside, the actuator rod 54 is pulled outwardly as illustrated in FIG. 3 so that the baffle deflector 50 assumes the deflecting position shown in FIG. 3. In this position, the heated air will be deflected into the interior of the housing 20 and will pass through the filter 42 into the room.

It will be noted that the deflector 50 is infinitely movable between the closed position of FIG. 2 and the deflecting position of FIG. 3 so that varying amounts of heated air can be deflected into the room. Thus, in moderate weather, it may be desirable to vent only part of the air into the room and an appropriate adjustment can be made with the actuator rod 54. The rubber grommet provides a tight connection between the rod 54 and the housing so that the rod will be held by the grommet in any adjusted position.

Figure 6:
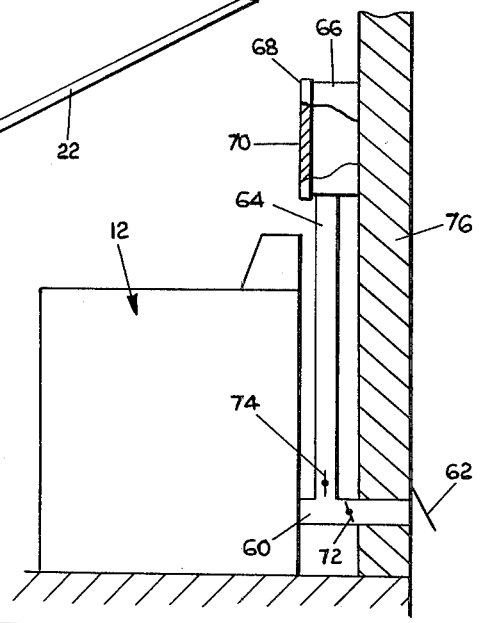
FIG. 6 is a schematic side elevational view of a modified form of the invention.

Reference is now made to FIG. 6 for a description of the second embodiment of the invention. In this embodiment, a dryer 12 has an outlet pipe 60 connected thereto for exhausting heated air from the dryer through a wall 76 and through a vent flap 62 to the outside of the building. A branch pipe 64 is connected to the outlet pipe 60 and a filter box housing 66, like housing 20, is connected to the upper end of the branch pipe 64. The filter box housing 66 has a hinged front door frame 68 which is like the door frame 22 in all respects. A standard furnace filter 70 is positioned at the front part of the housing 66 and behind the front door 68. A damper valve 72 is provided in the vent line 60 and a damper valve 74 is provided in the branch line 64. These damper valves control the flow of heated air through the vent flap 62 or alternatively through the filter box housing 66. The damper valves 72 and 74 are conventional valves which are adjustable so that the proportion of heated air flowing into the filter box and through the vent flap is adjustable substantially between 0% and 100%.

Figure 7:
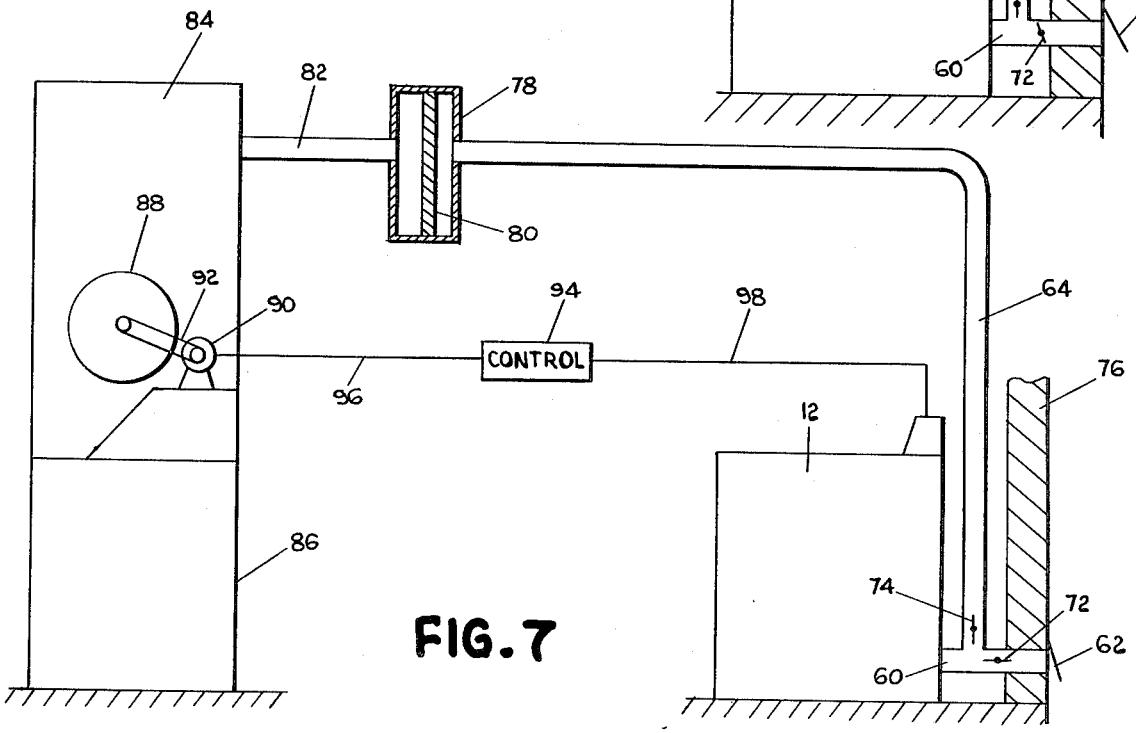
FIG. 7 is a schematic view of a second modified form of the invention.

Reference is now made to FIG. 7 for a description of the third embodiment of the invention. In this figure, like numerals have been used to designate like parts.

The dryer is connected to a vent pipe 60 having an adjustable valve 72 fo exhausting heated air through the wall 76 and through the vent flap 62. A branch pipe 64 is connected to the vent pipe 60 and has a damper valve 74 for controlling the relative proportion of heated air flowing through the branch pipe 64. A filter housing 78 having a standard fiberglass furnace filter 80 positioned therein is connected to the outlet of the branch pipe 64. The filter housing 78 is closed with the exception of the inlet connected to the branch pipe 64 and an outlet connected to an outlet pipe 82. A furnace 86 having a bonnet or air duct 84 is connected to the outlet pipe 82. The air duct is a part of the air duct which extends throughout the house. A fan 88 is driven by a motor 90 through drive belt 92 to circulate the air through the air duct and throughout the room or house in which the dryer is placed.

The motor 90 is connected to a controller 94 through a control line 96. The controller 94 is also connected to the dryer through a control line 98. The controller is adapted to switch the motor 90 into an operating mode when the dryer is running. In this manner, the air is circulating through the air duct 84 whenever heated air is vented through the branch pipe 64 and into the air duct 84. Thus, circulation of the air prevents condensation of moisture within the hot air ducting system.

The embodiment of FIG. 7 operates in substantially the same manner as the embodiment of FIG. 6. Heated air from the dryer can be vented to the outside completely by closing off valve 74 or alternatively can be vented completely through the branch line 64 by closing off the valve 72 and opening up the valve 74. Alternately, the valves 72 and 74 can be adjusted to give varying degrees of flow of the heated air through the vent pipe 60 and the branch pipe 64 as desired to maintain certain temperatures. The heated air passing through the branch pipe 64 will pass through the filter housing 78 and thereafter pass into the bonnet 84 of the furnace whereupon it will be circulated throughout the hot air duct system of the house. In this manner, humidity and heat are added to the hot air system in the house and such heat and humidity flow through the normal heating channels.

Whereas the invention has been described with reference to venting the heated dryer air into a room containing the dryer, it is within the scope of the invention to vent the heated air into a room other than the dryer room. When the dryer room is relatively small, the heated air can be conducted to an adjacent or remote room through conventional ducting.

Reasonable variation and modification are possible within the scope of the foregoing disclosure and drawing without departing from the spirit of the invention.

The embodiments of the invention in which an exclusive property or privilege is claimed are defined as follows:

1. A vent assembly for use in combination with a clothes dryer in a room wherein the dryer has an outlet pipe extending therefrom for venting heated air from the dryer, the vent assembly comprising:

a housing having an open rectangular front, closed back and side walls and a generally open interior;

a conduit extending through said housing at one side thereof from an inlet opening in said housing to an outlet opening in said housing;

means on said housing for coupling said dryer outlet pipe to said conduit at said inlet opening thereof;

means on said housing for coupling an exhaust pipe to said conduit at said outlet opening thereof for exhausting heated air from the room containing the vent assembly;

valve means in said conduit for adjustably controlling the relative proportion of heated gas passing from said inlet opening to either the interior of said housing or to said outlet, said valve means adapted to substantially completely cut off the flow of heated air to the housing open interior or, alternatively, to the outlet opening, said valve means further adapted to direct heated air into said housing parallel to the open rectangular front of the housing when flow of heated air to the outlet opening is at least partially cut off;

rectangular filter means at and covering only the open front of the housing, said filter means including a rectangular supporting rim supporting a central filter medium; and means for releasably retaining the filter means at the open front of the housing;

whereby heated air from the dryer can be vented in whole or part to the outside of the room or to the inside of the room through the vent assembly.

2. A vent assembly according to claim 1 wherein said releasable retaining means comprises a frame pivotably mounted at one side to one side of said housing and means for releasably securing the other side of said frame to an opposite side of said housing.

3. A vent assembly according to claim 1 wherein the valve means comprises an opening in said conduit facing a side wall of said housing and a valve element movable from a first position covering said opening to a second position blocking flow through said conduit downstream of said conduit opening;

said valve element being of a size and shape sufficient to cover said conduit opening when it is in the first position and to substantially completely block flow of air through said conduit when it is in a second position.

4. A vent assembly according to claim 3 and further comprising an actuator rod pivotably mounted at one end to said valve element and extending through said housing at another end so that said valve element is manually operable from outside said housing.

5. A vent assembly according to claim 4 and further comprising means for pivotably mounting said valve element to said conduit at a point downstream of said conduit opening.

* * * * *